United States Patent [19]

McLeod

[11] 4,452,756

[45] Jun. 5, 1984

[54] METHOD FOR PRODUCING A MACHINABLE, HIGH STRENGTH HOT FORMED POWDERED FERROUS BASE METAL ALLOY

[75] Inventor: Keith C. McLeod, Iona Station, Canada

[73] Assignee: Imperial Clevite Inc., Rolling Meadows, Ill.

[21] Appl. No.: 390,340

[22] Filed: Jun. 21, 1982

[51] Int. Cl.[3] ..... B22F 3/26; B22F 3/14

[52] U.S. Cl. ..... 419/29; 419/14; 419/38; 419/48; 419/53; 419/55; 75/236; 75/246

[58] Field of Search ..... 419/14, 38, 48, 10, 419/53, 55; 75/246, 236, 237, 257

[56] References Cited

U.S. PATENT DOCUMENTS 4,086,390 4/1978 Mitani et al. ..... 75/246

OTHER PUBLICATIONS

Goetzel, C. G.; *Treatise on Powder Metallurgy;* 1950, pp. 406–414.

Lyman, T. (ed.); *Metals Handbook,* 8th Edition; vol. 1, 1961, p. 106.

*Primary Examiner*—Benjamin R. Padgett
*Assistant Examiner*—Anne Brookes
*Attorney, Agent, or Firm*—Russell E. Baumann

[57] ABSTRACT

A method for producing a machinable, high strength hot formed powdered ferrous base metal alloy is provided which comprises providing a particulate mixture consisting of, in weight percent, from about 1.0 to about 3.0 percent copper, from about 0.16 to about 0.35 percent sulfur, from about 0.4 to about 0.8 percent carbon, with the balance being iron plus from 0 to about 2 percent incidental impurities; forming this particulate mixture into a preformed article having a predetermined configuration; sintering the so-formed article at a temperature sufficient to produce the desired alloy; and subjecting the sintered article to a hot forming treatment to produce a hot formed, machinable, high strength ferrous base powdered metal alloy article having a density near theoretical.

16 Claims, No Drawings

METHOD FOR PRODUCING A MACHINABLE, HIGH STRENGTH HOT FORMED POWDERED FERROUS BASE METAL ALLOY

BACKGROUND OF THE INVENTION

The present invention relates to a method of producing a high density ferrous based powdered metal alloy which is characterized by its high strength and exceptional machinability.

It is well known that the strength of conventionally produced ferrous alloys can be increased by adding thereto certain minor amounts of copper. Unfortunately, while copper produces certain desirable results with regard to increased strength, its use has associated therewith certain detrimental features. For example, the addition of copper to conventional ferrous based alloys often causes them to exhibit hot shorting, i.e., causes them to exhibit excessive internal cracking.

To overcome this problem of hot shorting, high density ferrous based alloys have been produced by conventional powder metal technology. These articles are produced by forming the desired article to its final shape or configuration. However, when it is desired to machine such resultant articles difficulty is experienced in that they evidence poor machinability.

Accordingly, it is the principal object of the instant invention to provide a method of producing a high density powdered ferrous based metal alloy which is characterized by its exceptional strength and high degree of machinability.

SUMMARY OF THE INVENTION

In one aspect, the subject invention concerns a method for producing a machinable, hot formed powdered ferrous base alloy comprising providing a particulate mixture consisting of, in weight percent, from about 1.0 to about 3.0 percent copper, from about 0.16 to about 0.35 percent sulfur, from about 0.4 to about 0.8 percent carbon, with the balance being iron plus from 0 to about 2.0 percent incidental impurities; forming said mixture into a preformed article having a predetermined configuration; sintering the so-formed article at a temperature sufficient to produce the desired alloy; and subjecting the sintered article to a hot forming treatment so as to produce a hot formed article having a density approaching theoretical.

In another aspect, the present invention concerns a hot formed powdered ferrous based alloy which is obtained by a process comprising the steps of providing a particulate mixture consisting of, in weight percent, from about 1.0 to about 3.0 percent copper, from about 0.16 to about 0.35 percent sulfur, from about 0.4 to about 0.8 percent carbon, with the balance being iron plus from 0 to about 2.0 percent incidental impurities; forming said mixture into a preformed article having a predetermined configuration; sintering the so-formed article at a temperature sufficient to produce the desired alloy; and subjecting said sintered article to a hot forming treatment so as to produce a hot formed article having a density approaching theoretical.

DESCRIPTION OF THE PREFERRED EMBODIMENT OF THE INVENTION

The composition used in the practice of the instant invention is one which includes minor amounts of copper, sulfur and carbon with the major component being iron. This composition may contain up to 2.0 weight percent of impurities, such as magnesium, silicon and aluminum.

In the practice of the instant invention, particulate copper, sulfur, carbon, iron and a suitable lubricant are mixed together to form an intimate homogeneous mass. The various alloying components of the mixture are utilized in an amount such that the resultant mixture consists of, in weight percent, from about 1.0 to about 3.0 percent copper, from about 0.16 to about 0.35 percent sulfur, from about 0.4 to about 0.8 percent carbon, with the balance being iron plus from 0 to about 2.0 percent incidental impurities. The exact particle size of the individual alloying components is not critical except that it must be such that they can be readily compacted so as to produce a preformed article which can be further processed in accordance with the practice of this invention.

While it is not an essential requirement of the process of the invention, it is common practice to add a lubricant to the mixture of alloying elements. This is done to aid in mixing and to facilitate compaction. Various lubricants can be used for this purpose. Such lubricants include zinc sterate and ACROWAX (a fatty diamide synthetic wax produced by Glycol Chemical Inc. of N.Y., N.Y.)). However, as the type of lubricant utilized in the practice of the instant invention is well known in the powder metallurgy art, it will not be discussed herein in detail.

Once a homogeneous mixture of the hereinabove mentioned ingredients is obtained an appropriate amount thereof is formed into a preformed article having a predetermined configuration. This forming step is accomplished by compacting the desired amount of particle mixture in a mold. The degree of compaction is not critical except that it must be an amount sufficient to produce a final sintered hot formed article having a density which approaches theoretical. In practice, it is desired to compact the unsintered alloying materials to a density which is in excess of 75 percent of theoretical.

The so-compacted article is then subjected to a sintering treatment at a temperature and for a duration of time sufficient to produce the desired alloy composition. The exact sintering parameters followed are a function of the exact amounts of the specific ingredients utilized to produce the desired resultant powdered metal alloy. While sintering can be accomplished in an inert atmosphere, in the practice of the instant invention, it is desired to use a controlled endothermic atmosphere. As these types of atmospheres are well known in the art, they will not be discussed herein in detail.

After sintering, the resultant article is then subjected to a hot forming technique, such as hot forging. This hot forming (i.e., hot forging) is carried out in a conventional manner to a degree sufficient to cause the resultant hot forged powdered metal article to exhibit a density of about 99 percent or greater of theoretical.

The so-produced high strength, hot formed powdered metal alloy article then can be readily machined. The resultant article is a ferrous based powdered metal article which exhibits exceptional strength and excellent machinability.

The subject invention will now be described in greater detail with reference to the following example of the preferred practice of the invention. This example is set forth for the purposes of illustrating the invention and is not intended to limit the same.

PREFERRED PRACTICE OF THE INVENTION

1. A suitable mixer is selected and first purged with raw iron to remove any contaminants therefrom.

2. The mixer is then charged with 75 pounds of copper, 12½ pounds of sulfur, 30 pounds of carbon, 50 pounds of lubricant (ACROWAX) and 2,500 pounds of iron. The copper powder was sized such that 100 percent passed through a 200 mesh screen. The sulfur was sized such that 100 percent passed through a 325 mesh screen. The carbon was sized such that 100 percent passed through a 325 mesh screen. The iron powder was sized such that 100 percent passed through an 80 mesh screen. The specific particle size distribution of the iron powder, on a percentage basis was, 0.1 percent through 80 on 100 mesh, 12.1 percent through 100 on 140 mesh, 29.5 percent through 140 on 200 mesh, 15.4 percent through 200 on 230 mesh, 19.3 percent through 230 on 325 mesh, and 23.6 percent through 325 mesh. The lubricant (ACROWAX) was sized such that 99.9 percent passed through a 325 mesh screen.

3. The above described materials were then mixed to insure that the powders were well distributed.

4. 2,383.5 pounds of raw iron, having a particle size distribution as above-described, was then added to the foregoing mixture.

5. These powders were then remixed for approximately 30 minutes to obtain a homogeneous mixture.

6. The powder mixture was then tested to be sure that the desired degree of homogeneity had been achieved.

7 An appropriate amount of the foregoing mixture was then placed in a mold cavity and briquetted at a pressure of approximately 30 tons per square inch to a density in the range of from about 6.1 to 6.7 gm/cc. The so-produced briquetted preformed article was self-supporting and of a general cylindrical shape having two opposing vertical wings or ears extending from the side walls thereof.

8. The so-formed article was then placed in an oven and sintered in a controlled endothermic atmosphere. The sintering atmosphere consisted of a mixture of hydrogen, carbon monoxide, nitrogen, carbon dioxide, methane and water. The concerned article was held at a temperature of about 2,050° F. for approximately 20 minutes to produce the desired alloy composition.

9. The so-sintered article was then removed from the sintering furnace and coated with a graphite and water solution while still warm (approximately 300° F.) to permit the water to evaporate and the graphite to be deposited on the surface of the concerned article.

10. The graphite-coated article was then heated to a forming temperature of approximately 1,900° F. in a controlled endothermic atmosphere. The specific heating cycle utilized was first to heat the article to 1,400° F., then to 2,050° F. and finally to 1,900° F. The concerned article was heated in each of the before-mentioned temperature ranges for approximately 8 to 10 minutes.

11. The so-heated article was then placed in a die cavity and a force of approximately 50 to 53 tons per square inch was exerted to produce a resultant article having an apparent density of 7.8 gm/cc.

12. The hot formed article was removed from the die and permitted to cool off in the ambient atmosphere.

13. The hot formed article was then machined to the desired final dimensions in a conventional manner without experiencing any degree of difficulty.

Articles produced by the foregoing technique evidenced exceptionally high strength and are characterized by their exceptional machinability. Typically, articles produced according to the teachings of the present invention have a tensile strength in excess of about 92,000 psi with an elongation in the order of 20%. From the foregoing, it is clear that the present invention renders it possible to produce hot formed, powder ferrous base metal articles which have exceptional strength and are characterized by their excellent machinability.

While there have been described herein what are at present considered to be the preferred embodiments of this invention, it will be obvious to those skilled in the art that various changes and modifications may be made without departing from the invention, and it is therefore, aimed in the appended claims to cover all such changes and modifications as fall within the true spirit and scope of the invention.

I claim:

1. A method for producing a machinable, ductile high strength hot formed powdered ferrous metal alloy comprising:

providing a particulate mixture consisting of, in weight percent, from about 1.0 to about 3.0 percent copper, from about 0.16 to about 0.35 percent sulfur, from about 0.4 to about 0.8 percent carbon, with the balance being iron plus from 0 to about 2.0 percent incidental impurities;

forming said mixture into a preformed article having a predetermined configuration;

sintering said so-formed article at a temperature sufficient to produce the desired alloy; and subjecting said sintered article to a heating and forming treatment so as to produce a hot formed article having a density near theoretical.

2. The method of claim 1 wherein said sintered, hot formed article is subjected to a machining treatment to produce an article having the desired final dimensions.

3. The method of claim 1 wherein said particulate mixture is subjected to a mixing treatment to produce a homogeneous mixture of particles prior to being formed into an article of the desired configuration.

4. The method of claim 1 wherein said sintered preformed article is coated with a graphite lubricant prior to subjecting it to a hot forming treatment.

5. The method of claim 1 wherein said hot forming treatment is a hot forging treatment.

6. The method of claim 1 wherein said preformed article is compacted to a degree sufficient to cause it to have a density which is greater than 75 percent of theoretical.

7. The method of claim 1 wherein said sintered preformed article is reheated prior to being hot formed.

8. The method of claim 5 wherein said sintered article is subjected to a hot forging treatment to a degree sufficient to produce a resultant article having a density of at least 99 percent of theoretical.

9. A machinable, ductile high strength powdered ferrous based metal alloy which is produced by a process which comprises the steps of:

providing a particulate mixture consisting of, in weight percent, from about 1.0 to about 3.0 percent copper, from about 0.16 to about 0.35 percent sulfur, from about 0.4 to about 0.8 percent carbon, with the balance being iron plus from 0 to about 2.0 percent incidental impurities;

forming said mixture into a preformed article having a predetermined configuration;

sintering said so-formed article at a temperature sufficient to produce the desired alloy; and subjecting said sintered article to a heating and forming treatment so as to produce a hot formed article.

10. The article of claim 9 wherein said sintered, hot formed article is subjected to a machining treatment to produce an article having the desired final dimensions.

11. The article of claim 9 wherein said particulate mixture is subjected to a mixing treatment to produce a homogeneous mixture of particles prior to being formed into an article of the desired configuration.

12. The article of claim 9 wherein said sintered preformed article is coated with a graphite lubricant prior to subjecting it to a hot forming treatment.

13. The method of claim 9 wherein said hot forming treatment is a hot forging treatment.

14. The method of claim 9 wherein said preformed article is compacted to a degree sufficient to cause it to have a density which is greater than 75 percent of theoretical.

15. The article of claim 13 wherein said sintered article is subject to a hot forging treatment to a degree sufficient to produce a resultant article having a density of at least 99 percent of theoretical.

16. The article of claim 9 wherein said sintered preformed article is reheated prior to being hot formed.

* * * * *